US008729372B2

(12) United States Patent
Goto

(10) Patent No.: US 8,729,372 B2
(45) Date of Patent: May 20, 2014

(54) ADJUSTER FOR STRING INSTRUMENTS

(75) Inventor: Masaki Goto, Gunma (JP)

(73) Assignee: Gotoh Gut Co., Ltd. (JP)

( * ) Notice: Subject to any disclaimer, the term of this patent is extended or adjusted under 35 U.S.C. 154(b) by 106 days.

(21) Appl. No.: 13/412,272

(22) Filed: Mar. 5, 2012

(65) Prior Publication Data

US 2013/0139670 A1 Jun. 6, 2013

(30) Foreign Application Priority Data

Dec. 2, 2011 (JP) ..... 2011-264847

(51) Int. Cl.
*G10D 1/08* (2006.01)

(52) U.S. Cl.
USPC ..... 84/312 R; 84/207

(58) Field of Classification Search
USPC ..... 84/312 R, 207
See application file for complete search history.

(56) References Cited

U.S. PATENT DOCUMENTS 4,224,857 A * 9/1980 Infeld ..... 84/302
2007/0095194 A1 5/2007 Moerth

* cited by examiner

*Primary Examiner* — Jianchun Qin
(74) *Attorney, Agent, or Firm* — Thompson Hine L.L.P.

(57) ABSTRACT

An adjuster with a frame attachable to the front end portion of an instrument tailpiece, a lever member with a base portion and a front plate portion swingably supported by the frame, a mounting portion with an adjusting screw positioned therein, an anchoring portion extending from the lever member that projects through an anchor hole to the surface side of the tailpiece to removably anchor a string of the instrument, and a swing transmitting member provided to the frame so as to be interposed between the adjusting screw and the lever member. The swing transmitting member is swingably supported by the frame and includes one or more transmitting levers extending along the string. When the adjusting screw is screwed into the mounting portion, one end of the transmitting lever is pushed down and another end pushes up the lever member, and the anchoring portion is swung to stretch the string.

4 Claims, 5 Drawing Sheets

ADJUSTER FOR STRING INSTRUMENTS

BACKGROUND OF THE INVENTION

1. Technical Field

The present invention relates to an adjuster that may be mounted on a tailpiece of a string instrument and that facilitates tuning of very small pitches.

2. Background Art

String instruments such as violins, violas, cellos, etc., have pegs for tightening and loosening strings for tuning. In addition, there may be cases in which tuning devices called "adjusters" are used in order to finely adjust very small pitches. The adjusters are used for tuning from a back end side of the strings that is an opposite side of the pegs. This kind of adjuster is specifically often used for the thinnest string (a first string in a case of a violin) and is mounted on a tailpiece that is fixed to a back end portion of a body of the string instrument. As a conventional adjuster, an adjuster of ball-end type is disclosed in Japanese Unexamined Patent Application Publication (Translation of PCT Application) No. 2007-513359, for example.

FIG. 6 shows a tailpiece of an ordinary violin. The tailpiece 6 has a front end portion (right end portion in FIG. 6) for stretching four strings, and the front end portion is formed with anchor holes 11 for anchoring back ends of the strings. The anchor hole 11 is made by forming a circular hole 11*a* at the back of a slit 11*b* that extends in the front-back direction. The circular hole 11*a* allows a ball to pass therethrough. The slit 11*b* allows the string to pass therethrough. The string has a ball that is fixed at the back end. The string is passed through the slit 11*b* by passing the ball through the hole 11*a* from a surface side, and the string passed through the slit 11*b* is stretched forward. Thus, the string is provided with tension.

FIGS. 7A and 7B show one of the adjuster of ball-end type. This adjuster has a frame 101 extending in the front-back direction. The frame 101 has a back end (left end in FIGS. 7A and 7B) provided with a cylindrical screw portion 102. The screw portion 102 is formed with threads at an outer circumferential surface and at an inner circumferential surface and extends upwardly. The screw portion 102 is passed through the hole 11*a* from a back side (lower side in FIGS. 7A and 7B) of the tailpiece 6, and the screw portion 102 projecting from the tailpiece 6 is screwed with a nut 103. Thus, the adjuster is fixed to the tailpiece 6. The frame 101 abuts on the back surface of the tailpiece 6 and has a front end portion that projects forward from a front end edge of the tailpiece 6. The front end portion of the frame 101 supports an L-shaped lever 105 via a pin 106 so that the lever 105 is swingable in a direction indicated by an arrow H. The lever 105 has a hook portion 104 by which a string 8 is anchored with a ball 200. The hook portion 104 is formed with a slit 104*a* that opens upwardly so as to allow the string 8 to pass through. An adjusting screw 107 is screwed into the screw hole inside the screw portion 102. The adjusting screw 107 abuts on a back end of the lever 105, and the lever 105 swings according to a screwed amount of the adjusting screw 107, whereby tuning is performed.

On the other hand, FIGS. 8A and 8B show an adjuster of another type. This tuning device is called an "adjuster of the loop-end type" and basically has the same structure as that of an adjuster of the ball-end type. That is, the adjuster has a frame 111 provided with a screw portion 112. The screw portion 112 is passed through the hole 11*a* from the back side of the tailpiece 6 and is screwed with a nut 113. An adjusting screw 117 is screwed into a screw hole inside the screw portion 112 and swings a lever 115. The lever 115 is swingably supported via a pin 116 by the frame 111 and has a hook portion 114. In this case, the lever 115 swings within the slit 11*b*, which is different from the structure of the adjuster of ball-end type. Moreover, the hook portion 114 is close to the nut 113, whereby there is no space for the ball. Therefore, a looped back end of the string 8 is anchored to the hook portion 14.

In the adjuster of the ball-end type shown in FIGS. 7A and 7B, the lever 105 is relatively long, and the string 8 is tightened by pressing the back end portion of the lever 105. Therefore, only a small controlling force is required, and tuning is easily performed. Nevertheless, since the hook portion 104 is arranged forward from the front end edge of the tailpiece 6, the total length of the string 8 is short. For example, in a case of using the adjuster for one string, balance of musical sounds of the string with other strings is difficult to control. In addition, a backward extra string between the back end of the string 8 and a bridge (9*b* in FIG. 2) has a length that is greatly different from those of the other strings. Accordingly, musical performance such as afterglow of musical sounds may be affected by the backward extra strings.

In contrast, in the adjuster of the loop-end type shown in FIGS. 8A and 8B, since the hook portion 114 is arranged over the anchor hole 11, the length of the string 8 is not much different from those of the other strings. However, the lever 115 is relatively short, and thereby large controlling force is required. In addition, the lever 115 swings in a relatively small range. Accordingly, tuning is not easily performed.

In each of the adjusters of the ball-end type and the loop-end type, the lever 105 (115) is swung by the adjusting screw 107 (117) that passes through the hole 11*a*. Since the lever is made to be pressed by the adjusting screw, a space between the lever and a body surface of the string instrument is small. Accordingly, the swing range of the lever, that is, the tuning range, is limited.

SUMMARY OF THE INVENTION

The present invention has been completed in view of the above circumstances, and an object of the present invention is to provide an adjuster that facilitates tuning and that does not greatly affect musical sounds.

The present invention provides an adjuster made so as to be mounted on a tailpiece on a surface side of a string instrument. The tailpiece has a front end portion and is formed with an anchor hole for a string. The adjuster includes a frame, a mounting portion for an adjusting screw, a lever, an anchoring portion, an adjusting screw, and a swing transmitting member. The frame is made so as to be removably fixed to the front end portion of the tailpiece with a fixing means. The mounting portion is provided to the frame in a side of the front end portion of the tailpiece. The lever is made so as to be arranged by passing through the anchor hole. The lever is supported by the frame so as to be swingable in a direction for stretching the string. The anchoring portion is provided at the lever and is made so as to project through the anchor hole to the surface side of the string instrument. The anchoring portion removably anchors a back end of the string. The adjusting screw is mounted by screwing it from the surface side of the instrument into the mounting portion of the frame. The swing transmitting member is provided to the frame so as to be interposed between the adjusting screw and the lever. The swing transmitting member swings the lever to a tightening side or a loosening side in the direction for stretching the string according to the screwed amount of the adjusting screw.

In the present invention, the swing transmitting member may swing the lever to the tightening side by screwing the adjusting screw into the mounting portion.

In addition, in the present invention, the swing transmitting member may include at least one transmitting lever that is swung by the adjusting screw.

In the present invention, the transmitting lever may have a lever portion that is directly swung by the adjusting screw, and the lever may be reversely swung with respect to the swung direction of the lever portion.

Moreover, in the present invention, the fixing means may include a retainer plate and a fixing screw member. The retainer plate is rotatably supported by the frame and retains the front end portion of the tailpiece between the retainer plate and the frame. The fixing screw member presses and fixes the retainer plate to the tailpiece.

In the present invention, the fixing screw member may be a nut and may be provided at the mounting portion so as to be coaxial with the adjusting screw.

According to the present invention, an adjuster that facilitates tuning and does not greatly affect musical sounds is provided.

BRIEF DESCRIPTION OF DRAWINGS

FIG. 3A shows an assembled condition of the adjuster, and FIG. 3B shows a disassembled condition of the adjuster.

FIG. 4A is a top view, FIG. 4B is a side view, FIG. 4C is a front view, and FIG. 4D is a bottom view.

FIG. 5A is a view showing a movable range of a lever member, FIG. 5B is a view of the adjuster when a string is most tightened, and FIG. 5C is a view of the adjuster when a string is most loosened.

FIG. 7A is a view of the adjuster mounted on a tailpiece, and FIG. 7B is a view showing a movable range of a lever.

FIG. 8A is a view of the adjuster mounted on a tailpiece, and FIG. 8B is a view showing a movable range of a lever.

PREFERRED EMBODIMENT OF THE INVENTION

An embodiment of the present invention will be described with reference to figures hereinafter.

Figure 1:
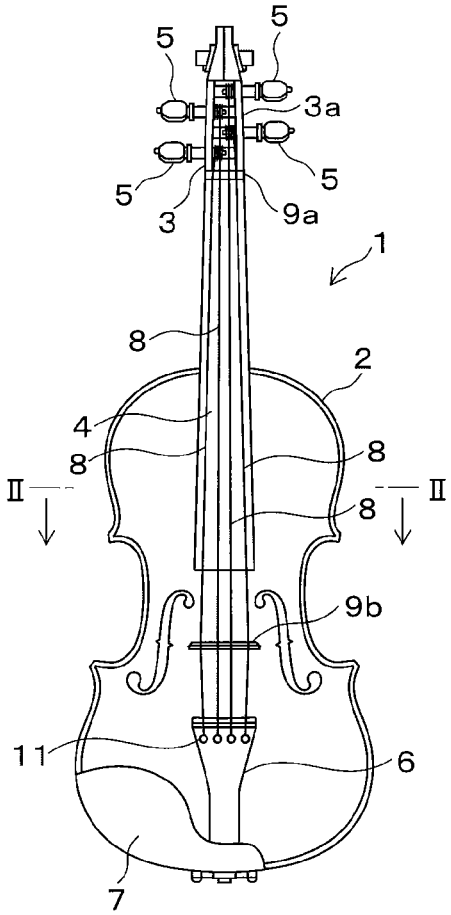
FIG. 1 is a plan view of a string instrument (violin) to which an adjuster relating to an embodiment of the present invention can be applied.
Figure 2:
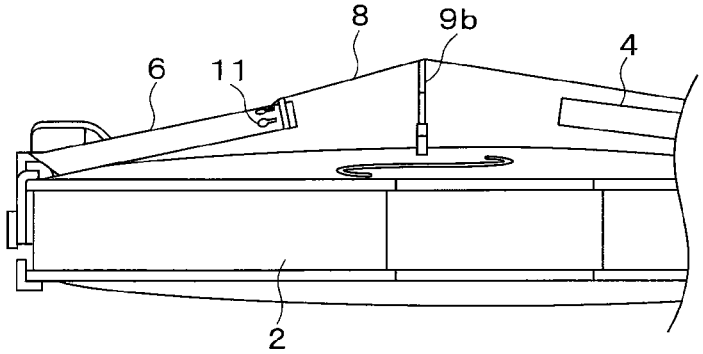
FIG. 2 is a side view of the violin in an arrow side from a line II-II in FIG. 1.

FIG. 1 shows an ordinary acoustic violin (string instrument) to which an adjuster of an embodiment can be mounted. FIG. 2 is a side view of the violin in an arrow side from a line II-II in FIG. 1. The violin 1 includes a body 2, a neck 3, a finger board 4, four pegs 5, a tailpiece 6, a chinrest 7, and four strings 8 (a first string, a second string, a third string, and a fourth string in order from the right side in FIG. 1). The body 2 forms a hollow sound box. The neck 3 extends to a front end side (upper side in FIG. 1) of the body 2 and has a pegbox 3*a* at a front end portion. The fingerboard 4 is fixed on a surface of the neck 3. The pegs 5 are mounted to the pegbox 3*a*. The tailpiece 6 and the chinrest 7 are fixed to a back end portion (lower end portion in FIG. 1) of the body 2.

Each of the strings 8 is stretched between the peg 5 and the tailpiece 6 and is supported by an upper bridge 9*a* and a bridge 9*b*. The upper bridge 9*a* is arranged at the front end portion of the neck 3. The bridge 9*b* stands between the fingerboard 4 and the tailpiece 6 on the surface side of the body 2. Each of the strings 8 is provided with tension by winding or unwinding the peg 5, whereby musical pitch is adjusted, that is, tuning is performed. The string 8 between the upper bridge 9*a* and the bridge 9*b* is called an effective string, and the string 8 extending from the bridge 9*b* to the tailpiece 6 is called a backward extra string.

Figure 6:
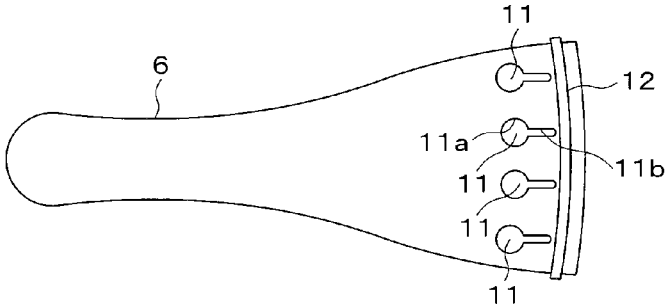
FIG. 6 is a plan view of a tailpiece.

As shown in FIG. 6, the tailpiece 6 is formed with the four anchor holes 11 that have the holes 11*a* and the slits 11*b* and are aligned according to the strings 8. As shown in FIG. 6, the anchor holes 11 on the surface of the tailpiece 6 have a front side that is formed with a ridge line 12. The ridge line 12 extends across in a front-back direction and supports the strings. The string 8 anchored by the anchor hole 11 contacts the ridge line 12 and is thereby supported. Therefore, more exactly, the string extending from the bridge 9*b* to the ridge line 12 is used as the backward extra string.

As described above, in the violin 1, the side of the peg 5 is a front side, and the side of the tailpiece 6 is a back side. The following descriptions relating to a front-back direction are based on this front-back direction of the violin 1. On the other hand, as a vertical direction of a thickness direction of the body 2, a side, at which the strings 8 are stretched, is a surface side.

(1) Structure of Adjuster

Figure 3A:
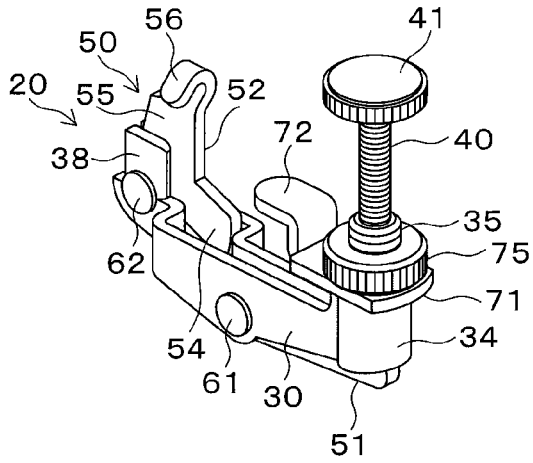
FIGS. 3A and 3B are perspective views of the adjuster.
Figure 3B:
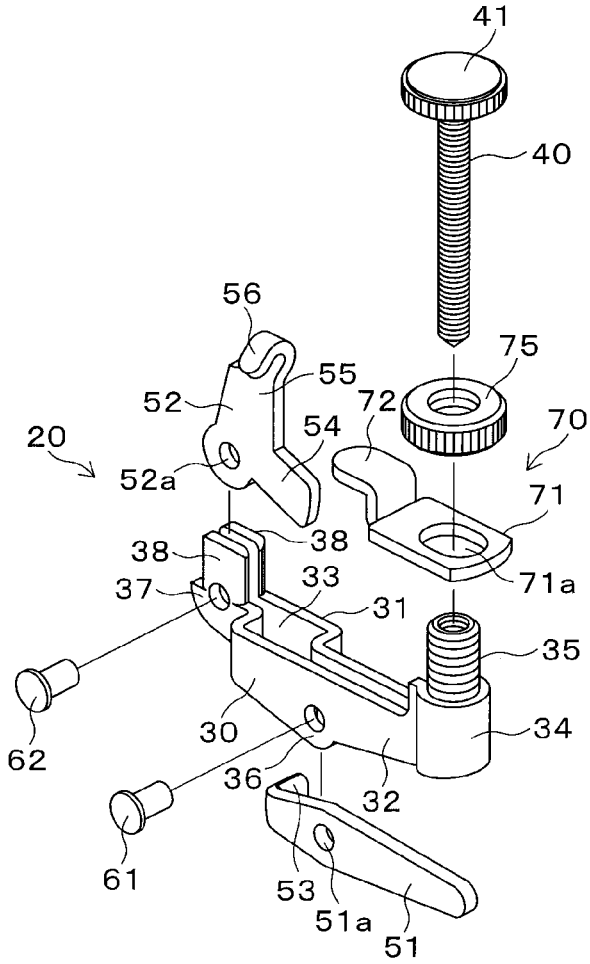
Figure 4A:
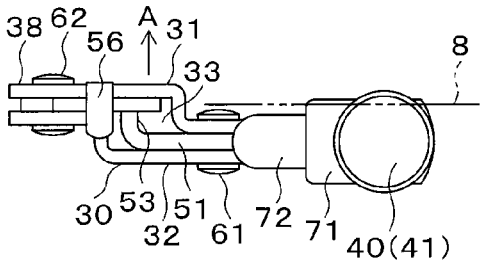
FIGS. 4A to 4D are four orthogonal views of the adjuster.
Figure 4B:
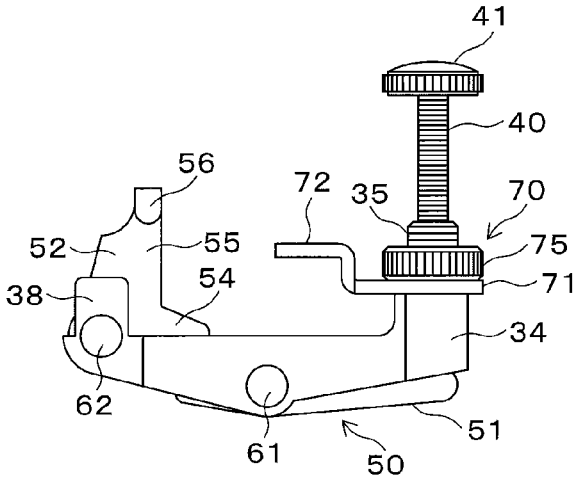
Figure 4C:
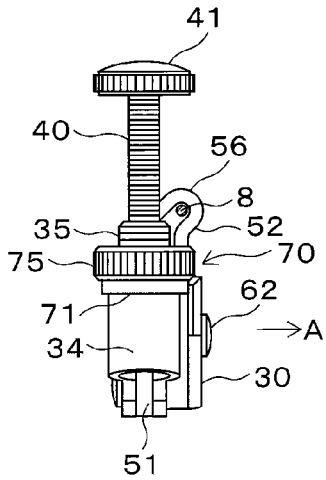
Figure 4D:
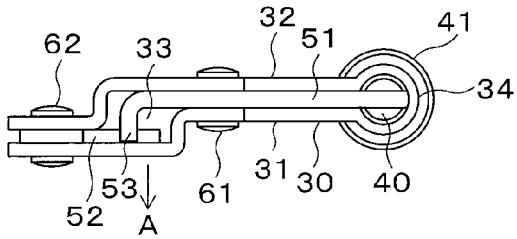
Figure 5A:
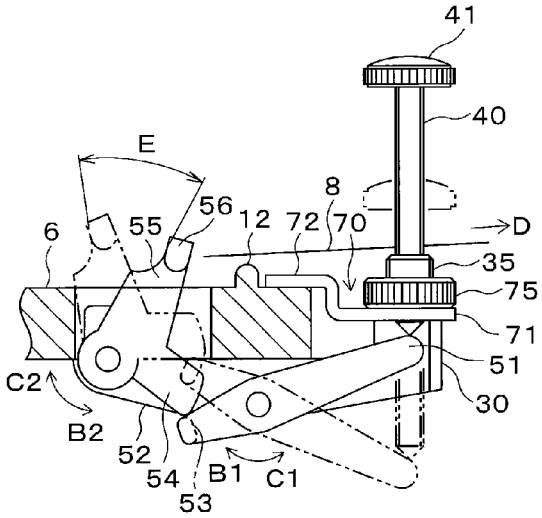
FIGS. 5A to 5C are side views of the adjuster mounted on a tailpiece.
Figure 5B:
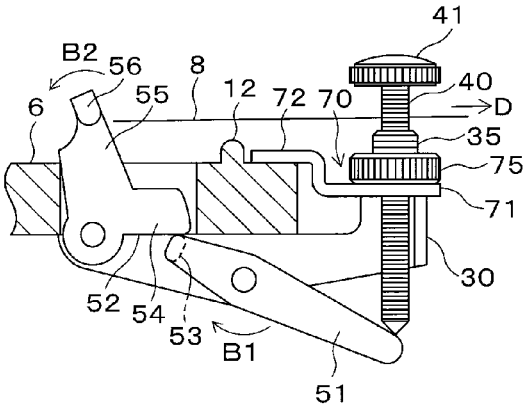
Figure 5C:
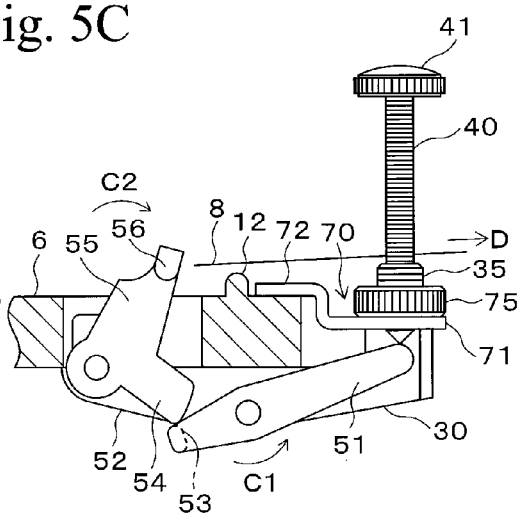

FIGS. 3A to 5C show an adjuster 20 of an embodiment. FIG. 3A is a perspective view of the adjuster 20 in an assembled condition, and FIG. 3B is a perspective view of the adjuster 20 in a disassembled condition. FIGS. 4A to 4D are four orthogonal views, and FIGS. 5A to 5C are side views of the adjuster 20 mounted on the tailpiece 6. As shown in FIGS. 3A to 5C, the adjuster 20 includes a frame 30, an adjusting screw 40, and a lever member 50. The frame 30 extends in the front-back direction in a condition in which the adjuster 20 is mounted on the tailpiece 6. The adjusting screw 40 is downwardly screwed into a front end portion of the frame 30. The lever member 50 is swingably supported by the frame 30 and is controlled by the adjusting screw 40.

The frame 30 is made by forming a strip plate into a hairpin shape, thereby having a folded portion at a front end side and plate portions 31 and 32 at right and left sides. The entireties of the plate portions 31 and 32 extend parallel with a space therebetween, and a back end side of the frame 30 is open. The right and left plate portions 31 and 32 are cranked to one side in a width direction (A direction side in FIG. 4A, 4C, and 4D) at different positions in a longitudinal direction. Therefore, a space 33 with a width larger than the other space is formed between the plate portions 31 and 32. As shown in FIG. 4A, in the frame 30, the right and left plate portions 31 and 32 are bent to the one side in the width direction, whereby the entirety of the back end portion is offset to the one side in the width direction. The back end portion is provided with a supporting portion 37 for a second lever (lever) 52 which will be described later.

The frame 30 has a front end that is formed into a cylindrical shape, and this cylindrical portion 34 has a top on which a cylindrical screw portion (mounting portion) 35 is uniformly formed. The screw portion 35 is formed with threads at an outer circumferential surface and an inner circumferential surface and extends upwardly. The screw portion 35 is made so that a fixing means 70 is mounted. The fixing means 70 includes a retainer plate 71 and a nut (fixing screw member) 75. The retainer plate 71 is downwardly passed and is fitted to the screw portion 35 and is assembled so as to be rotatable around the screw portion 35. The nut 75 is downwardly screwed on external threads at the outer circumferential surface of the screw portion 35. The retainer plate 71 has an end that is formed with a retaining portion 72 with an inverted L-shape in a side direction. The retainer plate 71 is formed with a hole 71*a* through which the screw portion 35 passes.

The adjuster 20 is mounted on the tailpiece 6 by the fixing means 70 as follows. First, in a front side of an anchor hole 11 of the tailpiece 6, at which a string 8 is to be tuned, the retainer plate 71 is horizontally turned, whereby the retaining portion 72 is positioned at the back side. In this condition, a space between the retaining portion 72 and the frame 30 is made to face the front end edge of the tailpiece 6. Then, the front end portion of the tailpiece 6 is inserted into the space and is thereby held between the retaining portion 72 in the surface side and the frame 30 in the bottom side. The nut 75 is screwed so that the retainer plate 71 is pressed toward the tailpiece 6, whereby the tailpiece 6 is strongly held between the retaining portion 72 and the frame 30. Thus, the adjuster 20 is mounted on the tailpiece 6.

The structure of the adjuster 20 in this mounted condition will be described hereinafter.

The screw hole inside the screw portion 35 is screwed by the adjusting screw 40 from above. The adjusting screw 40 has an upper end that is formed with a knob 41. As the adjusting screw 40 is screwed into the screw portion 35, the adjusting screw 40 downwardly penetrates the frame 30. The frame 30 supports the lever member 50 so as to be swingable in the direction for stretching the string, that is, in the front-back direction. The lever member 50 is controlled so as to swing by the adjusting screw 40. The lever member 50 is arranged in the back side of the adjusting screw 40 and includes a first lever (swing transmitting member, transmitting lever, lever portion) 51 and the second lever 52. The first lever 51 is directly swung by the adjusting screw 40. The second lever 52 is arranged in the back side of the first lever 51 and is reversely swung by the first lever 51.

The first lever 51 is arranged inside the frame 30, that is, arranged between the right and left plate portions 31 and 32, and is swingably supported by a supporting portion 36 with a first pin 61. The supporting portion 36 for the first lever 51 is provided in the middle of the frame 30 and downwardly protrudes. The first pin 61 is fixed to the right and left plate portions 31 and 32. The first lever 51 is formed with a hole 51*a* through which the first pin 61 passes. The first lever 51 has a supporting point at the first pin 61 and swings in a direction indicated by an arrow B1-C1 shown in FIG. 5A with a guide of the right and left plate portions 31 and 32.

The first lever 51 has a front end portion in the front side of the hole 51*a* for the first pin 61. This front end portion is positioned on an extension of the axis line of the adjusting screw 40 and can come into contact with the leading end of the adjusting screw 40. The first lever 51 also has a back end portion in the back side of the first pin 61. This back end portion is bent to one side and thereby is formed with an action part 53 at which a front end portion of the second lever 52 abuts. As the first lever 51 swings in the direction indicated by the arrow B1 in FIG. 5A, the back end side including the action part 53 of the first lever 51 enters the space 33 between the right and left plate portions 31 and 32. That is, the action part 53 does not contact the frame 30 and enters the space 33, whereby the first lever 51 is swingable.

The second lever 52 is swingably supported by the supporting portion 37 with a second pin 62. The supporting portion 37 for the second lever 52 is formed of the back end portions of the right and left plate portions 31 and 32 and guide parts 38 that upwardly project from the back end portions of the plate portions 31 and 32. The second pin 62 is fixed to the right and left plate portions 31 and 32 at roots of the guide parts 38. The second lever 52 is formed with a hole 52*a* through which the second pin 62 passes. The second lever 52 has a supporting point at the second pin 62 and swings within the frame 30 including the space 33 in a direction indicated by an arrow B2-C2 shown in FIG. 5 with a guide of the right and left guide parts 38.

The second lever 52 is a plate with an approximately L-shape in the side direction and has a front plate portion 54 and an upper plate portion 55. The front plate portion 54 extends forward, the upper plate portion 55 extends upwardly, and they have a base portion that is formed with the hole 52*a*. The front plate portion 54 has a front end lower portion that can come into contact with the action part 53 of the first lever 51.

The upper plate portion 55 of the second lever 52 has a top end that is tapered and is crooked so as to form a hook portion (anchoring portion) 56. As shown in FIG. 4C, the hook portion 56 is once obtusely bent in the one side (A side) and is then crooked in a direction opposite to the one side. Thus, the hook portion 56 has an inner space that is offset to the one side of the adjusting screw 40. In a condition in which the adjuster 20 is mounted on the tailpiece 6, the upper portion including the hook portion 56 is passed through the hole 11, whereby the upper plate portion 55 of the second lever 52 is arranged. Therefore, the hook portion 56 normally projects from the surface of the tailpiece 6.

Figure 7A:
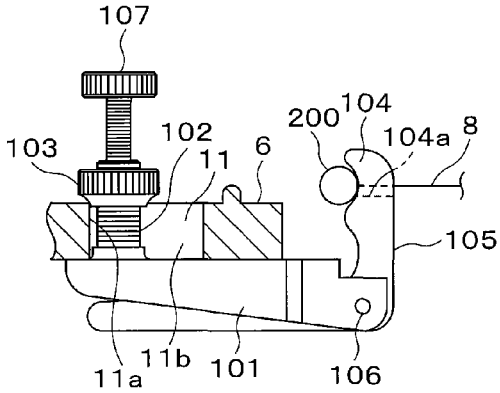
FIGS. 7A and 7B are side views of a conventional adjuster of the ball-end type.

The hook portion 56 of the second lever 52 anchors the back end of the string 8. The string 8 may be anchored with a ball-end (see FIG. 7A) using a ball or with a loop-end in which the back end portion of the string 8 is looped. In the case of the string 8 with the ball-end, the ball is hooked by the back side of the hook portion 56, and the string 8 is passed through the inside of the hook portion 56. In the case of the string 8 with the loop-end, the loop is hooked around the hook portion 56. As shown in FIGS. 4A and 4C, the string 8 is stretched by anchoring the back end thereof at the hook portion 56, and the string 8 passes by the one side of the adjusting screw 40. Therefore, the string 8 is tuned without contacting the adjusting screw 40.

The string 8 is anchored at the hook portion 56 of the second lever 52 and is provided with tension (a direction indicated by an arrow D in FIGS. 5A to 5C is a stretching direction of the string). Thus, the second lever 52 is normally biased so as to swing in the C2 direction by the string 8. Therefore, the front end lower portion of the front plate portion 54 normally presses down the action part 53 at the back end portion of the first lever 51. Consequently, the first lever 51 swings in the C1 direction, and the front end portion of the first lever 51 comes into contact with the leading end of the adjusting screw 40. When the string 8 is stretched, such a contacting condition is maintained.

(2) Usage and Movement of Adjuster

Usage and movement of the adjuster 20 having the above structure in this embodiment will be described.

(2-1) Tightening of Strings

In order to tune a tone to be higher by tightening the string 8 with the adjuster 20, as shown in FIG. 5B, the adjusting screw 40 is screwed so as to lower the leading end. Then, the first lever 51 is pressed by the adjusting screw 40 and swings in the B1 direction, and the second lever 52 correspondingly reversely swings in the B2 direction (tightening direction). As a result, the hook portion 56 swings back. In the second lever 52, the upper plate portion 55 is positioned in the hole 11*a* of the anchor hole 11. Accordingly, the tension of the string 8 is increased, and the tone is shifted to be higher.

(2-2) Loosening of Strings

In order to tune a tone to be lower by loosening the string 8 with the adjuster 20, as shown in FIG. 5C, the adjusting screw 40 is unscrewed and is raised. The front plate portion 54 of the second lever 52 is pulled by the stretched string 8 and thereby presses the action part 53 at the back end portion of the first lever 51. Therefore, the first lever 51 swings in the C1 direction while abutting the leading end of the adjusting screw 40, and the second lever 52 correspondingly swings in the C2 direction (loosening direction). As a result, the hook portion 56 swings forward. In the second lever 52, the upper plate portion 55 enters into the slit lib from the hole 11*a* of the anchor hole 11. Accordingly, the tension of the string 8 is decreased, and the tone is shifted to be lower.

The adjuster 20 is used as described above. According to the adjuster 20, the hook portion 56 of the second lever 52 moves in the front-back direction according to the screwed amount of the adjusting screw 40. Therefore, tuning is finely performed, and very small pitches are adjusted.

(3) Effects of Embodiment

According to the adjuster 20 of one embodiment, the hook portion 56 is positioned over the anchor hole 11. Therefore, the total length and the backward extra string length of the string 8 are not very different from those of other strings 8 which are directly anchored at the anchor holes 11 without using the adjuster 20. Accordingly, balance of musical sounds of the string 8 with the other strings 8 is maintained, and musical effects such as the afterglow of the musical sounds are not greatly affected by the backward extra strings.

The entirety of the lever member 50 including the first lever 51 and the second lever 52 has a length corresponding to a length from the front side of the tailpiece 6 to the hole 11*a* of the anchor hole 11. Therefore, controlling force for swinging the lever member 50 by the adjusting screw 40, that is, power necessary for rotating the adjusting screw 40, can be small. Specifically, in a case of tightening the string 8, the first lever 51 functions so as to raise the second lever 52 by a fulcrum function, whereby the controlling force can be small. Accordingly, tuning is easily performed.

Figure 7B:
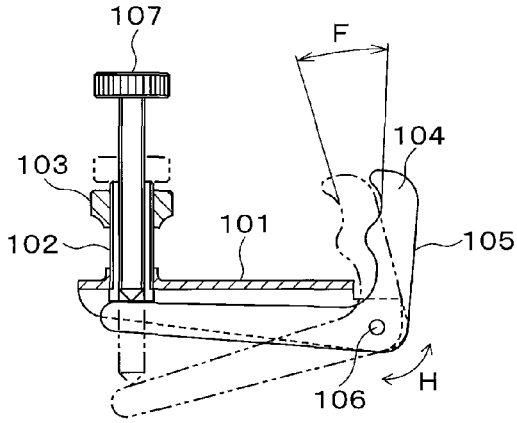
Figure 8A:
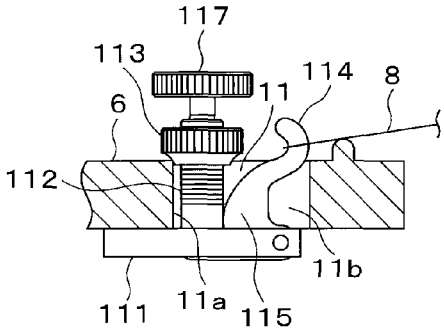
FIGS. 8A and 8B are side views of a conventional adjuster of the loop-end type.
Figure 8B:
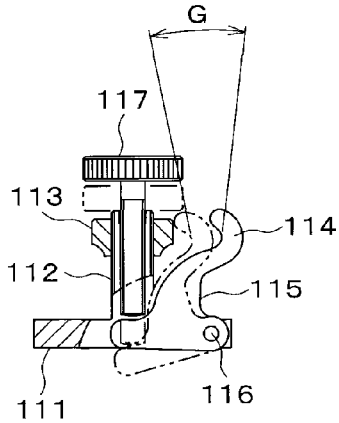

The second lever 52 is swung by the adjusting screw 40 in a movable range E shown in FIG. 5A. The movable range E is greater than movable ranges F and G of the levers of the conventional adjusters shown in FIGS. 7B and 8B. Therefore, the tuning range is large, and this also facilitates the tuning.

As shown in FIG. 2, the tailpiece 6 is inclined so as to be separate from the surface of the body 2 toward the front direction in the side of the bridge 9*b*. The adjusting screw 40 is arranged at the front side of the inclined tailpiece 6. Therefore, the adjusting screw 40 vertically moves in a greater range compared with a structure of passing the adjusting screw 40 through the anchor hole 11 as in the conventional device. As a result, the swing amount of the lever member 50 corresponding to the screwed amount of the adjusting screw 40 is increased, whereby the tuning amount is increased. This also facilitates the tuning.

The adjuster 20 of this embodiment is removably fixed to the tailpiece 6 with the fixing means 70 by fixing the retainer plate 71 with the nut 75. In order to remove the adjuster 20 from the tailpiece 6, the nut 75 is loosened, and the retainer plate 71 is turned around the screw portion 35, whereby the retaining portion 72 is removed from the tailpiece 6. In conventional adjusters, the adjusting screw must be unscrewed from the screw portion, and also, the nut must be removed from the screw portion in order to remove the conventional adjuster from the tailpiece 6. In contrast, in the adjuster of this embodiment, the adjuster is removed by loosening the nut 75. Therefore, the adjuster of the present invention is easily mounted and demounted with respect to the tailpiece 6.

The lever member 50 includes the two levers (the first and the second levers 51 and 52), and the second lever 52 is assembled so as to reversely move with respect to the movement of the first lever 51 that is directly swung by the adjusting screw 40. Therefore, only by screwing the adjusting screw 40, the second lever 52 moves back, and the string 8 is tightened. That is, the string 8 is tightened by screwing the adjusting screw 40 and is loosened by unscrewing the adjusting screw 40. Therefore, control feeling of the adjusting screw 40 corresponds to the tuning condition, whereby the adjuster 20 is convenient.

The adjusting screw 40 and the nut 75 are screwed to the screw portion 35 and are coaxially provided, whereby the adjuster can be reduced in size. According to this, in a case of mounting a second adjuster 20 on an adjacent string 8, a space between the adjacent adjusters 20 is increased. Therefore, the second adjuster 20 is easily mounted, and the adjusting screw 40 thereof is easily rotated.

The hook portion 56 may be used for the string 8 with the ball-end by anchoring the string 8 with the ball. In addition, the hook portion 56 may be used for the string 8 with the loop-end by anchoring the loop at the back end portion of the string 8. Therefore, the adjuster 20 can be widely used.

In the above embodiment, the first lever 51 forms the transmitting lever of the present invention, that is, the swing transmitting member. The number of the transmitting lever is not limited to one, and the transmitting lever may include plural levers that transmit swings to each other. As the swing transmitting member, any member may be used instead of the transmitting lever as long as the member has a means for swinging the second lever (lever) 52 according to the screwed amount of the adjusting screw 40. For example, a gear, which is made so as to be turned forward and in reverse by the adjusting screw 40, or a plurality of gear trains may be used. Alternatively, a combination of a gear and a lever may be used.

What is claimed is:

1. An adjuster made so as to be mounted on a tailpiece on a surface side of a string instrument, the tailpiece having a front end portion and formed with a substantially circular anchor hole for a string, the adjuster comprising:

a frame made so as to be removably fixed to the front end portion of the tailpiece, the front end portion being located at a front side from the anchor hole;

a lever member having a substantially L-shape and a base portion, the base portion being swingably supported by the frame;

a mounting portion for an adjusting screw, which is provided to the frame in a side of the front end portion of the tailpiece, the mounting portion being positioned outside a front end edge of the front end portion of the tailpiece;

an anchoring portion extending from the base portion of the lever member and made so as to project through the anchor hole to the surface side of the tailpiece, the anchoring portion removably anchoring a back end of the string;

a front plate portion extending from the base portion of the lever member to the front end portion of the tailpiece;

the adjusting screw mounted by screwing it from the surface side of the instrument into the mounting portion of the frame; and a swing transmitting member provided to the frame so as to be interposed between the adjusting screw and the lever member, the swing transmitting member swinging the lever member to a tightening side or a loosening side in the direction for stretching the string according to the screwed amount of the adjusting screw;

wherein the swing transmitting member is swingably supported by the frame and comprises one or more transmitting levers extending along the string; and wherein the adjusting screw is screwed into the mounting portion, whereby a front end portion of the transmitting lever is pushed down and a rear end portion of the transmitting lever pushes up a front end portion of the front plate portion, and the anchoring portion is swung to the tightening side in the direction for stretching the string.

2. The adjuster according to claim 1, wherein the transmitting lever has a lever portion that is directly swung by the adjusting screw, and the lever member is reversely swung with respect to the swung direction of the lever portion.

3. The adjuster according to claim 1, further comprising:

a retainer plate that is rotatably supported by the frame and retains the front end portion of the tailpiece between the retainer plate and the frame; and a fixing screw member that presses and fixes the retainer plate to the tailpiece.

4. The adjuster according to claim 3, wherein the fixing screw member is a nut and is provided at the mounting portion so as to be coaxial with the adjusting screw.

* * * * *